United States Patent [19]

Sledesky

[11] Patent Number: 4,486,629

[45] Date of Patent: Dec. 4, 1984

[54] JOYSTICK CONTROLLER

[75] Inventor: Stephen M. Sledesky, Hartford, Conn.

[73] Assignee: Coleco Industries, Inc., Hartford, Conn.

[21] Appl. No.: 514,598

[22] Filed: Jul. 18, 1983

[51] Int. Cl.[3] ..... H01H 25/04

[52] U.S. Cl. ..... 200/6 A

[58] Field of Search ..... 273/85 G; 200/5 R, 5 A, 200/6 A, 11 C, 17 R, 153 K

[56] References Cited

U.S. PATENT DOCUMENTS

| | | | |
|---|---|---|---|
| 2,857,485 | 10/1958 | Brooks | 200/6 A |
| 3,005,055 | 10/1961 | Mattke | 200/11 C X |
| 3,033,946 | 8/1962 | Meyer et al. | 200/6 A |
| 4,091,234 | 5/1978 | Bristow | 178/18 |
| 4,124,787 | 11/1978 | Aamoth et al. | 200/6 A |
| 4,148,014 | 4/1979 | Burson | 340/709 |
| 4,275,611 | 6/1981 | Asher | 74/471 X |
| 4,319,099 | 3/1982 | Asher | 200/5 A |
| 4,386,776 | 6/1983 | Bromley | 200/6 A X |
| 4,394,548 | 7/1983 | Dola | 200/6 A |
| 4,408,103 | 10/1983 | Smith | 200/6 A |
| 4,439,648 | 3/1984 | Reiner et al. | 200/6 A |

FOREIGN PATENT DOCUMENTS 148123 5/1981 German Democratic Rep. .

*Primary Examiner*—J. R. Scott

[57] ABSTRACT

A joystick type controller for controlling the X-Y coordinate movement of an object through closure of discreet switch contacts where tilting motion of the joystick handle is limited to predetermined directions, and the amount of pressure which may be applied to the contacts is limited.

8 Claims, 7 Drawing Figures

JOYSTICK CONTROLLER

FIELD OF THE INVENTION

This invention relates to manually operated controller assemblies for generating switch closures in response to X-Y coordinate movements of a member, such as a joystick, and is particularly useful in conjunction with manipulation of images or markers on a video display.

BACKGROUND OF THE INVENTION

Most video games employ a so-called joystick for purposes of generating switch closures in order to control directional movement of an object displayed on the video screen. Generally, such controllers comprise a lever or stick positioned upon a pivot providing means which serves to axially support the handle for movement in an arc in directions radially of the axis of the handle. A substrate carries a plurality of pressure-activated switches or switch contacts disposed in a predetermined pattern about the axis of the handle.

Generally, there are four switches or contacts equiangularly displaced ninety degrees to each other. Such switches may be referred to as spaced at cardinal points or directions. Such switch arrangements are disclosed in U.S. Pat. Nos. 4,124,787 and 4,319,099. Movement of the joystick at other than one of the cardinal points must be sensed by the closure of two switches. The system logic, in the case of most video games is arranged to do this. The system logic, however, will require the simultaneous closing of a pair of cardinal switches to sense a direction intermediate to the cardinal points. Often a video game player is not sufficiently skilled to close two switches or contacts simultaneously, or the construction of the assembly is such that it is difficult to repetitively achieve simultaneous closure of two adjacent cardinal point switches to signify an intermediate direction between the four cardinal directions. Also, dependent upon the construction of the switch actuating means operated by the handle, excessive pressure can be applied to a contact on the substrate. If such excessive pressure is repeatedly applied, it is possible that a contact, such as a rivet, could be loosened and lose electrical contact with a circuit path printed or otherwise defined on the substrate. Repetitive application of excessive pressure could damage any type of switching mechanism or contacts utilized to sense the direction of tilt or movement of the handle.

Accordingly, the present invention provides a new joystick mechanism which insures closure of contacts to signify a direction intermediate the cardinal directions. The present invention further provides means for limiting the pressure which can be applied to a switch or switch contact.

SUMMARY OF THE INVENTION

Briefly stated the invention, in one form thereof, is embodied in a video game controller which comprises a joystick or a handle member extending through the top wall of a housing member and having a flange which is biased downwardly from the top wall of the housing. This handle assembly is supported on a pivot providing member for tilting movement radially of the axes of the handle. A plurality of electrical contacts are positioned on a substrate in a predetermined angular pattern about the axis of the handle and located beneath the handle flange so that one or more of the switches may be operated by the flange upon tilting of the handle.

A member, having a plurality of flexible cantilevered arms, is disposed about the pivot providing means with the arms positioned over each contact. The arms have an upward projection which may be engaged by the flange. The arms are positioned over each switch contact. Projecting downwardly from each of these arms, are stop members. A spring contact member having an equal number of arms to the flexible member is positioned about the axis of the handle below the flexible arms. Each arm is adapted to be moved into electrical contact with one of the substrate contacts. The arms of the member have projections extending through apertures in each of the spring contact arms which permits such projections to bottom on the substrate and prevents further pressure from being exerted on the substrate contacts. Preferably the pivot providing member and the member with the cantilevered arms are formed integrally.

The invention further provides a new arrangement of switch contacts which insures that movement of the joystick handle intermediate the cardinal directions will result in appropriate contact closures. This is achieved by placing a pair of switch contacts intermediate each cardinal direction contact and electrically connecting each contact of the pair to one of the cardinal contacts.

The invention further contemplates the provision of a joystick pivot providing member which defines discreet directions in which the joystick may be tilted.

An object of this invention is to provide a new and improved direction controller of the joystick type.

Another object of this invention is to provide a controller of the joystick type having new and improved means for limiting the amount of force that can be applied to a switch or a switching contact.

A further object of this invention is to provide a new and improved controller of the joystick type having an increased number of switches or switch contacts disposed about the axis of a joystick handle which permits more positive switch contact to be made.

A still further object of this invention is to provide a new and improved joystick controller having new and improved means for providing more positive switch closures for a given direction of manipulation.

The features of the invention, which are believed to be novel, are particularly pointed out and distinctly claimed in the concluding portion of this specification. The invention, however, together with further objects and advantages thereof, may best be appreciated by reference to the following detailed description taken in conjunction with the drawings.

DETAILED DESCRIPTION OF THE DRAWINGS

Figure 2:
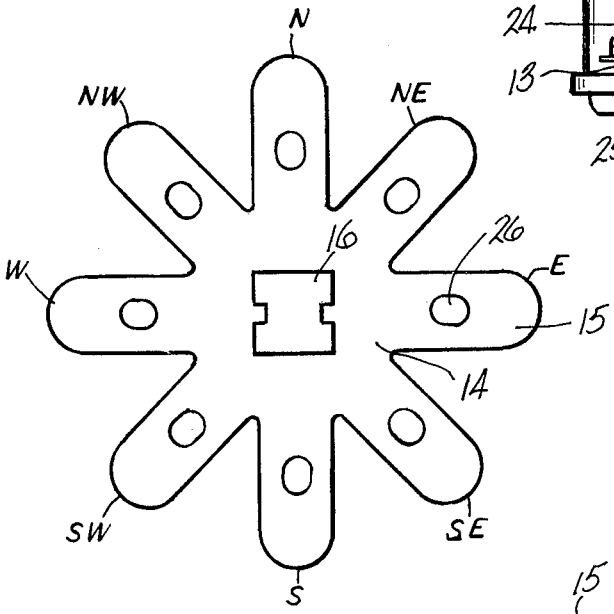
FIG. 2 is a plan view of a contact spring utilized in the device of FIG. 1.
Figure 1:
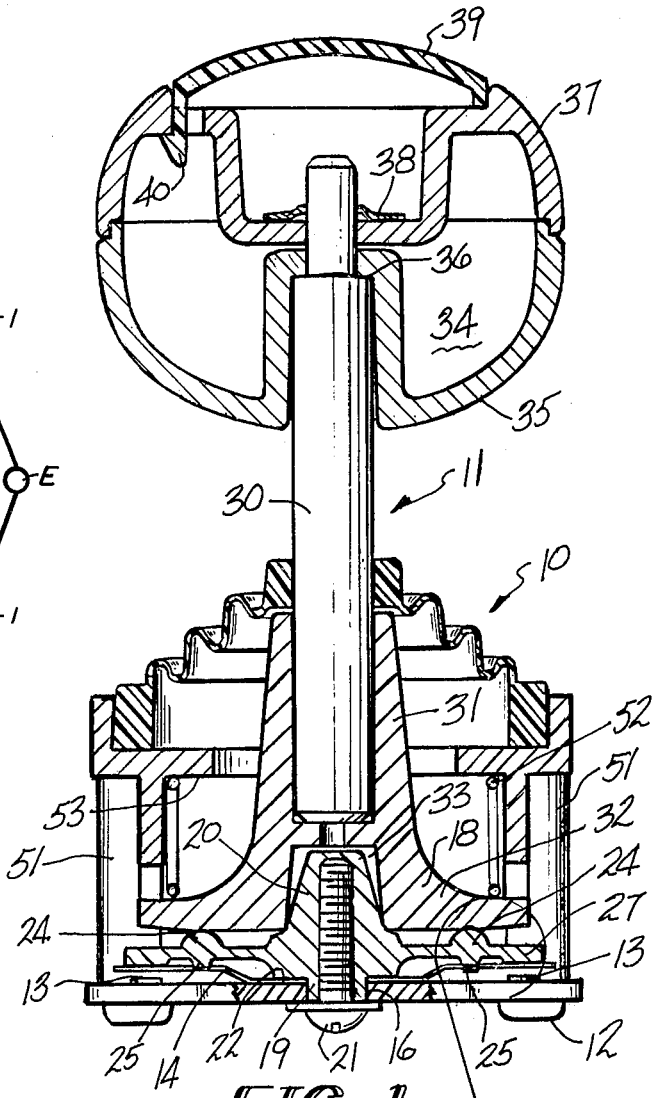
FIG. 1 is a half-section in elevation of a device embodying the invention.
Figure 6:
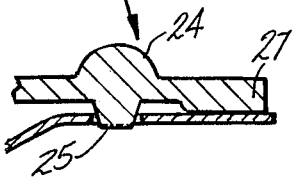
FIG. 6 is a sectional side elevation of a portion of the assembly of FIG. 1.
Figure 3:
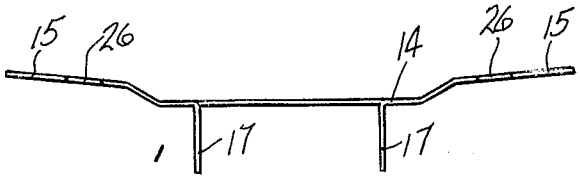
FIG. 3 is a side elevation of the contact spring of FIG. 2.

A joystick controller, as shown in FIG. 1, includes a handle portion 11, a substrate 12, having a plurality of electrical contacts 13 disposed about the longitudinal axis of handle member 11. Disposed above the contacts 13 is a spring contact member 14 having eight equiangularly radially extending arms 15 (FIG. 2). A generally rectangular opening 16 is defined in substrate 12 which receives depending legs 17 of contact member 14 with the arms 15 positioned above each of switch contacts 13.

Figure 5:
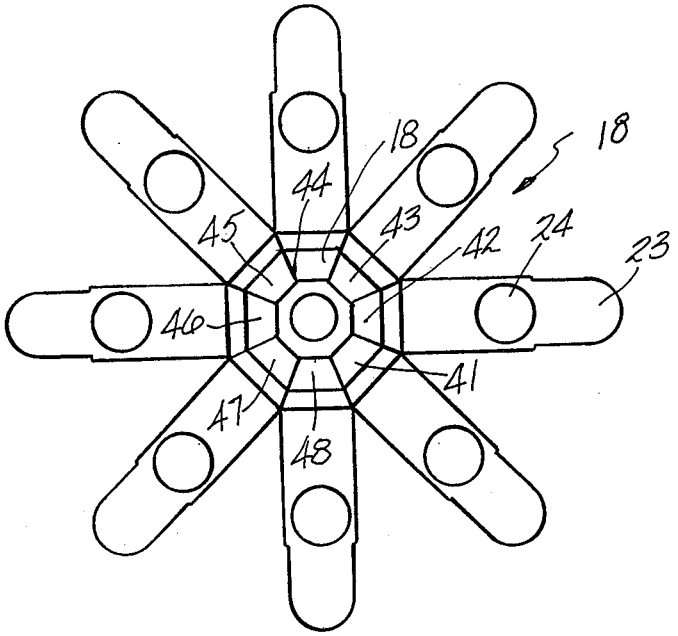
FIG. 5 is a top plan view of a contact actuating member which is interposed between the contact spring of FIGS. 2 and 3 and the handle member of FIG. 4.

A pivot providing member 18 has a lower projection 19 which is received in opening 16, and an upwardly extending pivot providing portion 20. Member 18 is secured to substrate, as shown, by a bolt or screw 21. A surface 22 of member 18, overlies member 14 and substrate 12. As shown in FIG. 5, member 18 has eight radially extending, equiangularly spaced arms 23. Each arm has a substantially hemispherical projection 24 on the upper surface thereof, spaced radially inwardly from the extremities of each of the arms 23. Each of the arms 23 also has a lower projection 25 spaced inwardly from the extremity thereof. The projections 25 are aligned with and adapted to extend through apertures 26 in each arm of spring contact number 14 for purposes hereinafter described. Each of the arms 23 also includes at the extremity thereof a portion of increased thickness 27 which is in substantial contact with an associated arm 15 of spring contact member 14.

The handle member 11 comprises a stem portion 30 having a member 31 thereon. Member 31 has a flange 32 on the lower end thereof. A well or recess 33 is defined centrally in member 31.

The upper portion of handle member 11 comprises a three part hand grip 34 which comprises a lower member 35 fitted on a shoulder 36 defined on stem 30. An intermediate member 37 is matingly fitted to member 35 and secured to stem 30 as by means of a lock washer 38. A top member 39 has depending legs 40 to lock to member.

The controller 10 may be arranged so that there is only one switch contact to be actuated at a time. To achieve this, the pivot providing portion 20 (FIG. 5) is formed with equiangularly spaced lands or surfaces 41–48 of trapezoidal shape. Surfaces 41–48 are upwardly and inwardly inclined toward the upper edges thereof. The edges defining well 33 in member 31 have surfaces **41*a*–48*a* matingly formed with respect to surfaces 41–48. When the handle 11 with member 31 is fitted to the pivot providing member 20, the surfaces 41–48 and 41*a*–48*a*** will be in substantial registry.

Substrate 12, together with an upper wall member 50, are spaced and joined by a plurality of columns 51. A helical spring 52 resting on surface 53 of wall member 50 biases flange portion 32 of member 31 downwardly and the handle into contact with the projections 24 on arms 15. This urges the surfaces 41–48 and **41*a*–48*a***, respectively into engagement.

Figure 4:
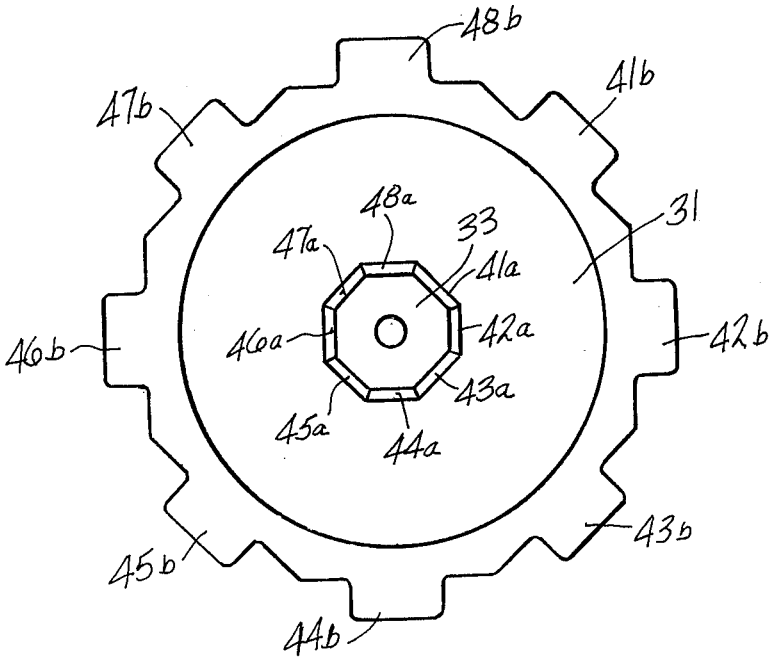
FIG. 4 is a bottom view of a handle member of FIG. 1.

With this arrangement, the handle 11 can only be tilted in eight directions and may only activate one of contacts 13 at a time. The flange 32 of handle 11 is defined with equiangularly radially extending arms **41*b*–48*b*, as most clearly seen in FIG. 4. Each of the arms 41*b*–48*b* may actuate an arm 23 of member 18, and an arm 15 of spring contact 14**.

In operation, when handle 11 is tilted about the pivot providing member in any one of eight directions, one of arms **41*b*–48*b* depress an arm 23 by acting on its upward projection 24 and cause portion 27 of the arm to move an arm 15 of contact number 14 into electrical engagement with a substrate contact 13 and complete an electrical circuit. If a sufficient tilting force is applied, the end of an arm 23 will tend to bend upwardly as a lower projection 25 extends through an aperture 26 of an arm 15 and the arm 15 bottoms on a contact 13 on substrate 12. When this occurs, any additional tilting force applied to the member 31 through handle 11 is transferred directly to the substrate and thus limits the force that can be applied through portion 27 of an arm 15 to a contact 13 on substrate 12**.

The joystick controller, as shown, is adapted to control eight directions of motion of an object which may be an image or a marker on a CRT screen. The joystick controller may be arranged to make eight different contacts, each spaced forty-five degrees from the other to signify eight different directions of movement.

A joystick controller embodying the invention may also be utilized with a system where the intermediate directions are sensed by simultaneous closure of two adjacent cardinal contacts.

Figure 7:
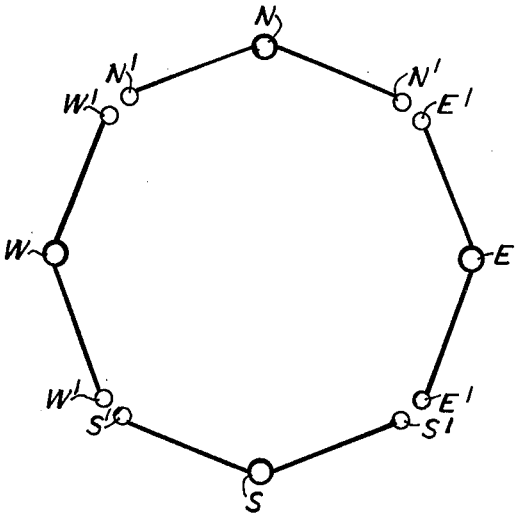
FIG. 7 is a plan view of a substrate useful in the assembly of FIG. 1.

In this environment, the substrate contacts are arranged, as shown in FIG. 7, where the contacts are labeled by direction N, S, E, W, etc. for the cardinal directions. The contacts for N'E'; S'E'; S'W'; and N'W' directions for NE, SE, SW, and NW comprise a pair of contacts, each contact electrically connected to adjacent cardinal direction contacts.

The spring contact arms 15 are sufficiently wide to span the two contacts intermediate the cardinal contacts. Each pair of intermediate contacts may be considered a single intermediate contact.

It may thus be seen that the objects of the invention are efficiently obtained. Modifications to the disclosed embodiment of the invention, as well as other embodiments thereof, may occur to those skilled in the art. Accordingly, it is intended that the appended claims cover all modifications and embodiments of the invention which do not depart from the spirit and scope thereof.

What is claimed is:

1. A controller for causing switch closures in response to X-Y coordinate movements, said controller comprising a base member including a substrate having a plurality of switch contacts equiangularly spaced about a central axis, a handle member having a longitudinal axis normally coincident with said central axis and having a lower annular flange extending radially therefrom, means supporting said handle thereon for tilting movement radially of the axis of the handle, said flange upon tilting of said handle being effective to close one of said contacts, said supporting means comprising an upwardly extending pivot providing member, a recess defined in said handle and receiving said pivot providing member, whereby said handle may tilt on said pivot providing member, a spring contact member carried on said substrate, said contact member having a plurality of radially extending contact arms, each overlying one of said substrate contacts and arranged to be deflected into electrical contact with one of said contacts by said flange, a resilient member disposed between said contact member and said flange and having a like number of resilient arms as said contact member each disposed over an arm of said contact member, each of said resilient arms having upper and lower projections spaced inwardly of the free ends thereof and positioned between the axis of said handle and said contacts on said substrate, said contact arms each having an aperture therein receiving said lower projections, whereby upon tilting of said handle, said flange engages one of said resilient arms on said upper projections and causes the associated contact arm to contact an associated substrate contact, said lower projection contacting said substrate upon predetermined tilting motion of said handle and thereafter transmitting the pressure of said flange to said substrate.

2. The controller of claim 1 where there are four cardinal switch contacts on said substrate and a pair of contacts spaced closely together intermediate each two adjacent cardinal contacts, each of a pair of said intermediate contacts being electrically connected to an adjacent cardinal contact.

3. The controller of claim 1 where said supporting means and said resilient arms are formed integrally.

4. A controller for causing switch closures in response to X-Y coordinate movements, said controller comprising a base member including a substrate having a plurality of equiangularly contacts spaced about a central axis, a handle member having a longitudinal axis normally coincident with said central axis and having a lower annular flange extending radially therefrom, means supporting said handle thereon for tilting movement radially of the axis of the handle, said supporting means comprising a pivot member for said handle, said pivot member having a plurality of flat sides of equal trapezoidal shape terminating in a common upper surface, said handle member defining a recess bounded by a number of edges equal to said number of surfaces, said edges engaging said surfaces, whereby said handle member may pivot only in directions determined by said surfaces, a plurality of electrical contacts on said substrate, a spring contact member carried on said substrate, said contact member having a plurality of contact arms overlying said substrate contacts and adapted to be moved into electrical engagement with an associated substrate contact, a plurality of resilient arms extending radially from said supporting means between said flange and said contact arms, said resilient arms having lower projections spaced inwardly from the free ends thereof adapted to contact said substrate, and transfer force from said flange to said substrate.

5. A controller for causing switch closures in response to X-Y coordinate movements, said controller comprising a base member including a substrate having a plurality of switch contacts equiangularly spaced about a central axis and having a lower annular flange extending radially therefrom, means supporting said handle thereon for tilting movement radially of the axis of the handle, a plurality of electrical contacts on said substrate, a spring contact member carried on said substrate, said contact member having a plurality of radially extending contact arms, each overlying one of said substrate contacts and arranged to be deflected into electrical engagement with one of said contacts by said flange, a resilient member disposed between said contact member and said flange and having a like number of resilient arms as said contact member, each resilient arm disposed over a contact arm, each of said resilient arms having upper and lower projections spaced inwardly of the free ends thereof and positioned between the axis of said handle and said contacts on said substrate, said contact arms having an aperture therein receiving said projections, whereby upon tilting of said handle, said flange engages one of said resilient arms on said upper projections and causes an associated contact arm to contact an associated substrate contact, said lower projection contacting said substrate upon predetermined tilting motion of said handle and thereafter transmitting the pressure of said flange to said substrate.

6. The controller of claim 5 where said resilient arms are formed integrally with said supporting means.

7. The controller of claim 5 wherein said supporting means predetermines the discreet directions in which the handle may be tilted.

8. The controller of claim 5 wherein said supporting means and said resilient arms are integral.

* * * * *